United States Patent [19]

Grüber

[11] 4,268,928

[45] May 26, 1981

[54] METHOD AND APPARATUS FOR APPLYING A LIQUID ON A MOVING WEB IN PATTERNS

[75] Inventor: Heinz Grüber, Tönisvorst, Fed. Rep. of Germany

[73] Assignee: Eduard Küsters, Krefeld, Fed. Rep. of Germany

[21] Appl. No.: 130,099

[22] Filed: Mar. 13, 1980

Related U.S. Application Data

[62] Division of Ser. No. 918,947, Jun. 26, 1978, Pat. No. 4,202,188.

[30] Foreign Application Priority Data

Jul. 8, 1977 [DE] Fed. Rep. of Germany ..... 2730891

[51] Int. Cl.[3] ..... D06B 11/00

[52] U.S. Cl. ..... 8/149; 427/288; 427/420

[58] Field of Search ..... 68/205 R; 118/DIG. 4, 118/325; 427/420, 288; 8/158, 149

[56] References Cited

U.S. PATENT DOCUMENTS

| | | | |
|---|---|---|---|
| 3,570,275 | 3/1971 | Weber et al. | 68/205 R |
| 3,964,860 | 6/1976 | Leifeld | 68/205 R X |
| 4,128,667 | 12/1978 | Timson | 118/DIG. 4 X |

*Primary Examiner*—Evan K. Lawrence

*Attorney, Agent, or Firm*—Kenyon & Kenyon

[57] ABSTRACT

In order to pattern a web using a method for applying a liquid to the moving web on which a cohesive liquid shroud falling on the web from above is interrupted in a pattern, a fluid medium is blown transversely against the falling shroud to displace portions thereof without affecting its cohesiveness.

6 Claims, 5 Drawing Figures

Fig. 1
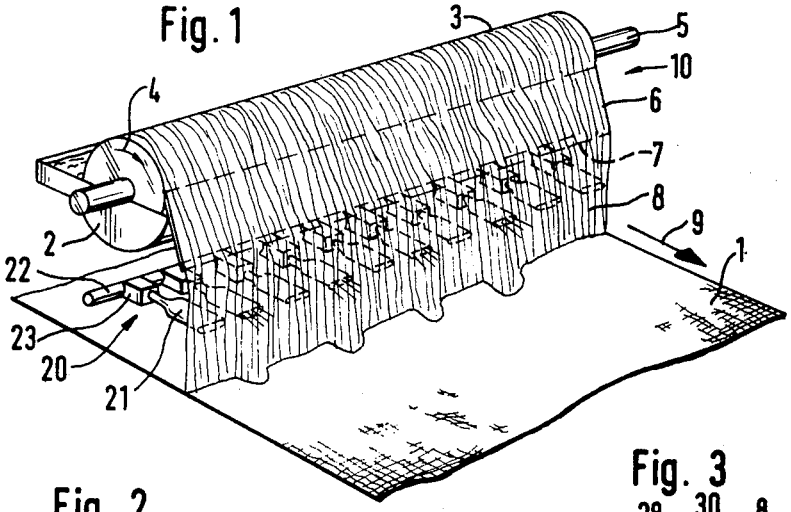
Fig. 2
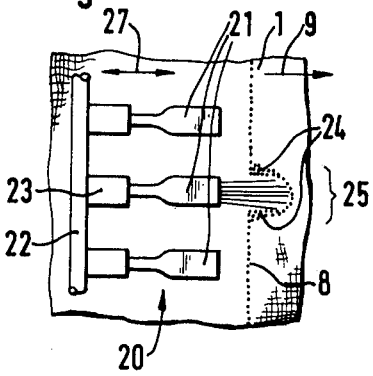
Fig. 3
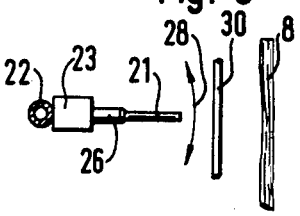
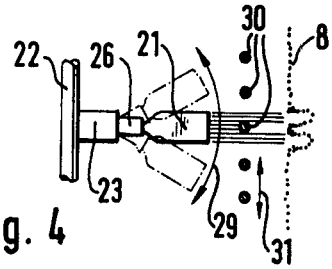
Fig. 4
Fig. 5
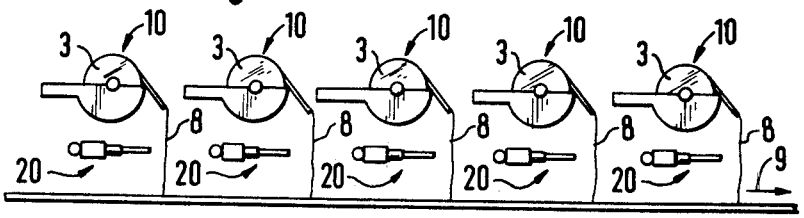

METHOD AND APPARATUS FOR APPLYING A LIQUID ON A MOVING WEB IN PATTERNS

This is a division of application Ser. No. 918,947 filed June 26, 1978, now U.S. Pat. No. 4,202,188.

BACKGROUND OF THE INVENTION

This invention relates to a method for applying a liquid on a moving web in patterns.

A method for applying a liquid on a moving web utilizing a liquid shroud falling on the web from above which is interrupted in a pattern and to apparatus suitable for carrying out this method along with a dyeing device assembled thereto is disclosed, in principle, by Patent DL No. 44 964. However, this patent only schematically illustrated the interruption of the shroud without disclosing a practical embodiment. Such an embodiment is the subject of the German Offenlegungschrift No. 23 35 234. In the disclosed device channels, which can be brought into the descent path of the shroud in a controlled manner and which then conduct the liquid found there into a collecting tray, are provided over the width of the web side by side for the purpose interrupting the liquid shroud, so that the web receives no liquid for the pattern at the locations of the channels. By suitably controlling the individual channels, a given patterns can be achieved, the appearance of which, however, is determined by the longitudinal stripes or sections thereof which correspond to the channels.

SUMMARY OF THE INVENTION

It is an object of the present invention to provide a method using apparatus of the type mentioned at the outset wherein the liquid can be applied in a freer and more irregular pattern.

According to the present invention, the solution of this problem comprises blowing a fluid medium transversely against the shroud to displace portions thereof without affecting its cohesiveness.

The fluid medium may be, in particular, air, but may also be a liquid when then must be compatible with the other liquid, of course.

By blowing on the air, no liquid is removed from the falling shroud. Instead, the amount of liquid uniformly available over the width of the web is merely made nonuniform by displacing the flow filaments of the falling liquid to one side at the point where a "hole" is made in the shroud by the blowing, and the filaments settle on thy web, at the one side, in larger amounts than in the vicinity of the "hole".

Blowing liquid directed against a web is known per se from German Auslegeschrift No. 1 460 349. In the disclosed system, however, the liquid is sprayed against the web from adjacent nozzles and thus does not form a cohesive shroud, and the liquid is kept away from the web by the blowing.

In the preferred embodiment of the present invention, the blowing of the fluid medium against the shroud is interrupted in a controlled manner.

In this manner, the application of the liquid is not only made nonuniform in the transversal direction (by the blowing), but the nonuniformity is also made variable in the longitudinal direction, so that the variety of patterns increases.

One important embodiment of the method of the present invention for dyeing nap textiles, and especially rugs, in patterns comprises interrupting several dyeing liquid shrouds in patterns by blowing and applying the shrouds to the web sequentially wet on wet. The dyeing liquids may, in particular, have different viscosities.

A pattern is then obtained by the superposition and merging of the dyeing liquids which are applied, each by itself, interrupted in a pattern. Through suitable choice and adjustment of different dyeing liquids and the sequence in time of their application, rug patterns can be obtained which can be achieved with no other method of pattern application.

The present invention is also embodimed in apparatus for applying a liquid on a moving web in a pattern, comprising a device, arranged above the web, for producing a liquid shroud which falls on the web and extends across the web, and an arrangement which is provided between the device for producing the liquid shroud and the web, and which interrupts the falling shroud in a pattern before it strikes the web, and is characterized by the feature that the arrangement comprises at least one nozzle which points toward the falling shroud, and by means of which a fluid medium can be blown transversely against the shroud.

So that the effect of the nozzles can be varied, the discharge direction of at least one of the nozzles can be varied, and at least one of the nozzles is also movable, particularly perpendicularly and/or parallel to the shroud.

Further variations are possible by providing a splitting element which splits the nozzle jet between at least one of the nozzles and the shroud.

The development of the nozzle jets is influenced thereby and the jet strikes the shroud in changed form.

Also, the effect of the splitting elements can be varied inasmuch as at least one of them is movable, particularly perpendicularly perpendicularly and/or parrallel to the shroud.

In one advantageous embodiment, the splitting elements consist of a grid arranged in front of the nozzles.

A facility for carrying out the above-mentioned method for dyeing nap textiles, particularly rugs, comprises several of the devices described above, which are arranged and operate in tandem in the travel direction of the web.

BRIEF DESCRIPTION OF THE DRAWINGS

FIG. 1 is a perspective view of an individual apparatus for dyeing rug webs in patterns.

FIG. 2 is a partial view corresponding to FIG. 1, from above onto the nozzle arrangement.

FIG. 3 is a side view of an embodiment modified by adding a grid.

FIG. 4 is a partial view corresponding to FIG. 3 from above.

FIG. 5 is a side view of a rug dyeing facility.

DETAILED DESCRIPTION OF THE INVENTION

The apparatus 10 in FIG. 1 is used for dyeing a rug web 1, horizontally advancing in the direction of the arrow 9, in patterns. Across and above the rug web 1, a trough 2 with dyeing liquid is arranged. A cylinder 3 has its lower part immersed in the dyeing liquid and takes dyeing liquid along at its surface when it rotates in the direction of the arrow 4 about the shaft 5 which is aligned transversely to the web of material. It is removed from the cylinder surface by a wiper 6 which is arranged on the descending side of the circumference of the cylinder 3 and points down toward the rug web 1 at an angle. The liquid flows over the surface of the wiper 6 and drops down from the lower edge of the latter in a shroud 8 which is uninterrupted across the rug web.

The above constitutes the apparatus for generating the liquid shroud.

Between the lower edge 7 of the wiper 6 and the rug web 1, a nozzle arrangement 20 is provided. The nozzle arrangement 20 comprises individual nozzles 21 which are realized in the illustrated embodiment as flat (duckbill) nozzles arranged parallel to the rug web 1, side by side close together. The nozzles are connected to a common air supply line 22 and can be connected to the air supply line 22 or separated therefrom by valves 23 which, for instance, are operated electrically.

The nozzles 21 blow crosswise against the falling shroud 8 and make the latter uneven in the striking area of the air jet in that the flow filaments of the liquid falling in the shroud 8 are displaced, as indicated in FIG. 2 for the middle nozzle. Because of the surface tension, the liquid shroud 8 is not simply displaced parallel to the travel direction of the rug web 1, which would not result in differences of the liquid application in the transversal direction, but the flow filaments accumulate preferentially in the zones 24 on both sides of the striking zone 25, as can be seen from FIG. 2. The liquid shroud 8 falls uninfluenced and uniformly in front of nozzles 21 which are not in operation, as can be seen in FIG. 1, where every second nozzle is inoperative.

In FIG. 1, the nozzle arrangement 20 is provided below the dyeing liquid trough 2. While this arrangement has advantages as far as space requirements are concerned, it is not essential for the operation; the nozzles 21 can also blow against the direction of travel.

The effect of the blasting can now be varied in different ways, as may be seen from FIGS. 2 to 4.

First, the entire nozzle arrangement can supported so as to be movable, according to FIG. 2, parallel to the travel direction 9 of the rug web as indicated by arrow 27. The effect of the impinging air jet is different, depending on whether the mouth of the nozzles 21 is close to the shroud 8 or farther away from the same.

The nozzle arrangement can furthermore be supported for rotation is shown by FIG. 3, in the direction of the arrow 28 upward and downward about a transversal axis and, as per FIG. 4, in the direction of the arrow 29 in a plane extending parallel to the rug web 1. The rotatability can be obtained in a simple manner by connecting the nozzle 21 to the valve 23 via an elastic tube 26. The movement is accomplished by means of suitable driving means which engage at the nozzles 21 but are not shown.

The effect of the nozzles 21 can furthermore be influenced by splitting elements arranged between the nozzles and the falling shroud 8 such as the grid 30 in FIGS. 3 and 4. The grid 30 and similar splitting elements placed in the jet of the nozzles 21 may likewise be movable in various ways, as is indicated by the arrow 31 in FIG. 4.

Other nozzle designs can also be used instead of the shape of the nozzles diagrammatically indicated in the figures. Similarly, a different fluid medium, for instance, a liquid can be blown against the falling shroud 8 instead of the air mentioned up to now. Of course, this liquid must be compatible with the dyeing process. In the case of aqueous dyeing liquids water can be used. An additional effect takes place here inasmuch as the liquid which gets onto the web additionally, influences the running of the dyeing liquid on the web and thus brings an additional component into the pattern.

In FIG. 5 a rug dyeing machine is shown, in which five devices 10 are connected in series. The five devices 10 operate wet on wet. The individual dyeing liquids applied in patterns get onto the nap of the rub web 1 one after the other, sink in to different depths, merge into each other at the edges and result in a quite unique, varied pattern which can be obtained with no other dyeing process. It is not a droplet-type pattern but a pattern with larger dyed zones which can be different particularly in the depth direction of the rug. If hues of different saturation of a color are used, uniquely changing appearances of the pattern can be produced. Through the size of the individual pattern fields, animation of the pattern is obtained, which has a pleasing effect on the eye, especially in the case of large areas such as can be considered for display goods. By using dyeing liquids with different viscosities, the ability to sink in and the interaction with the other dyeing liquids can be controlled. Dyeing liquids which exhibit differences with regard to other criteria, which have an effect on the shape of the pattern can, of course, also be used.

What is claimed is:

1. In a method for applying a liquid to a moving web in patterns, wherein a cohesive liquid shroud falling on the web from above is interrupted in a pattern, the improvement comprising blowing a fluid medium transversely against the falling shroud to displace portions thereof without affecting said cohesiveness.

2. The method according to claim 1, wherein the fluid medium is air.

3. The method according to claim 1, wherein the fluid medium is a liquid.

4. The method according to claim 1, and further including interrupting the blowing of the fluid medium against the shroud in a controlled manner.

5. The method according to claim 1 for dyeing nap textiles, especially rugs, in patterns and further including applying several dyeing liquid shrouds, which are interrupted by blowing in patterns, to the web one after the other wet on wet.

6. The method according to claim 5, wherein dyeing liquids of different viscosities are used.

* * * * *